US007963867B1

(12) United States Patent
Gait

(10) Patent No.: US 7,963,867 B1
(45) Date of Patent: Jun. 21, 2011

(54) OVER-MOLDED RUNNER FOR A LACROSSE POCKET

(75) Inventor: Paul Gait, Altamont, NY (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 9 days.

(21) Appl. No.: 12/264,188

(22) Filed: Nov. 3, 2008

Related U.S. Application Data

(60) Provisional application No. 60/985,035, filed on Nov. 2, 2007.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724; 24/715, 713.4, 24/713.5

See application file for complete search history.

(56) References Cited

U.S. PATENT DOCUMENTS

| | | | | |
|---|---|---|---|---|
| 4,049,273 | A * | 9/1977 | Pool | 473/513 |
| 4,273,331 | A * | 6/1981 | Fischer | 473/543 |
| 5,920,970 | A * | 7/1999 | Coblentz | 24/713 |
| 6,213,901 | B1 | 4/2001 | Collinson | |
| 6,447,410 | B2 | 9/2002 | Crawford | |
| 6,520,875 | B1 | 2/2003 | Crawford | |
| 7,278,936 | B2 | 10/2007 | Tucker, Jr. | |
| 2001/0044347 | A1 | 11/2001 | Crawford | |

FOREIGN PATENT DOCUMENTS

| | | | |
|---|---|---|---|
| CA | 2326206 | A1 | 5/2001 |
| CA | 2359858 | A1 | 4/2002 |

* cited by examiner

*Primary Examiner* — Gene Kim
*Assistant Examiner* — M Chambers
(74) *Attorney, Agent, or Firm* — Waddey & Patterson P.C.; Phillip E. Walker

(57) ABSTRACT

An over-molded runner for a lacrosse pocket comprising a substrate portion and an over-molded portion or optionally a completely molded runner providing for improved pocket characteristics.

9 Claims, 2 Drawing Sheets

OVER-MOLDED RUNNER FOR A LACROSSE POCKET

CROSS REFERENCED TO RELATED APPLICATIONS

This application is a non-provisional application which claims benefit of co-pending U.S. Patent Application Ser. No. 60/985,035 filed Nov. 2, 2007 entitled "Over-Molded Runner for a Lacrosse Pocket" which is hereby incorporated by reference.

The disclosure of all cited patents and publications referred to in this application are incorporated herein by reference.

BACKGROUND OF THE INVENTION

1. Technical Field

The present invention relates to an over-molded runner utilized for comprising a portion of a pocket for a lacrosse stick. More particularly, the present invention relates to an over-molded runner comprising a runner constructed of either leather or fibrous material which is then over-molded with an artificial material to create a runner having improved properties providing for greater traction and aesthetic appeal. The invention also includes the lacrosse head incorporating the novel over-molded runners.

2. Background of the Art

The lacrosse game originated with the American and Canadian native Americans. Traditionally, a lacrosse stick has a handle portion attached to a head with the head consisting generally of a frame and a pocket. It will be appreciated by those of ordinary skill in the art that a well constructed lacrosse head is essential in both the general play by and especially the success of participants of the sport of lacrosse.

Generally, the lacrosse head can be described as a basket that attaches to the end of the handle that is used to catch, transport, and deliver the ball as desired. The lacrosse head not only catches the ball and holds the ball during play, but is also used during defensive maneuvers and to obtain the ball during a face off. As such, the lacrosse head is subjected to both large and varying forces during the game. As such, lacrosse heads are typically formed of some type of plastic material which is rigid although can slightly deform so as not to crack or break under the typical stresses experienced during participation in a lacrosse game.

Traditionally, the pocket for the lacrosse head is strung by the player as the stringing of the pocket dictates the performance characteristics of the lacrosse stick. Unfortunately, if one string breaks or significantly weakens, the pocket will have to be either replaced or repaired prior to the stick being used again during game play. Furthermore, adjustments to the string tension within the pocket are significantly difficult as the majority of strings are tied off at various holes within the pockets requiring the tedious untying of knots or cutting and installation of new strings.

There are currently at least three popular ways to construct the lacrosse pocket;

Traditional: braided nylon or polyester lace woven between side wall and longitudinal runners (sometimes referred to as thongs). The runners are traditionally leather or braided nylon and run between the scoop and inside throat area of the lacrosse head. The pocket is woven to the head as it is being created. Most traditional pockets comprise four runners, cross lacing, and side wall stringing. These materials are typically hand woven or strung in the traditional manner to form a pocket. The stringing and/or weaving of a traditional pocket is very labor intensive and is typically done by hand.

Mesh: machine-woven nylon mesh is pre-manufactured and later attached to the side wall scoop and inside throat areas via string. This mesh material is machine made and is the integral body of the pocket. Furthermore, a mesh material allows for one consistent weave pattern.

Traditional/Mesh: a head that is strung with a combination of pre-manufactured mesh, hand-woven lace, and longitudinal runners.

One disadvantage to the traditional style of pocket is that the runners are typically comprised of natural materials and preferably leather which are responsible for absorbing a substantial amount of energy in both the catching and throwing of a lacrosse ball. As such, these runners wear quite rapidly and can be subject to early replacement. Furthermore, the runners comprising a lacrosse pocket are often constructed of materials capable of absorbing moisture. More specifically, the runners may absorb significant amounts of moisture and thereby stretch or shrink thus changing the throwing and catching characteristics of a lacrosse pocket. This may be undesirable to lacrosse players as the characteristics of the pocket are altered, thus requiring them to shift their style of throwing and catching a lacrosse ball or rework the pocket.

One additional area of improvement that exists in creating an improved pocket for a lacrosse stick is in the functionality of runners running longitudinally from the scoop to the throat of a lacrosse head. While mesh is often utilized, traditional pockets include runners which may provide additional spin on the lacrosse ball thereby resulting in greater control of the flight of the lacrosse ball. Additionally, traditional pockets are extremely popular in women's lacrosse where the pocket has a much shallower depth than a pocket of a lacrosse head as used in men's lacrosse. With the shallower pocket as maintained in women's lacrosse, it is vital to provide as much grip and control of the lacrosse ball as possible from the runners comprising the lacrosse pocket as the lacrosse pocket cannot aggressively maintain the ball within the strung lacrosse pocket per women's rules.

Both traditional pockets and mesh pockets take significant time to "break in" meaning that either the mesh or leather runners or both stretch significantly during the repeated impact, throwing, and cradling of a lacrosse ball within a lacrosse head. During this period, the player becomes accustomed to the pocket and must make adjustments to make it personalized as the pockets of the lacrosse sticks undergo both stretching and expansion. These adjustments are necessary as the pocket is arguably the most crucial part of a lacrosse stick as it is of the basis for good ball control, accurate passing, and fast, accurate shooting. As the pocket is broken in and is continued to be used for both game play and practice, the shape and the performance characteristics of the pocket change with continued use and may not be as desired by the player.

Unfortunately, with extended game play and practice, as well as the varying environmental conditions the lacrosse head pocket is exposed to, the runners may stretch, thus requiring the pocket to require significant adjustments. Additionally, there exist substantial improvements available in the composition of runners for both men and women's lacrosse pockets including improvements in precluding stretching and the absorption of moisture while improving the control of a lacrosse ball. Accordingly, there is a need for an improved runner for a lacrosse pocket that is less likely to absorb as much moisture as a traditional lacrosse runner while providing improved performance and handling characteristics as demanded by a lacrosse player.

Unfortunately, lacrosse pockets of the prior art do not include runners having improved gripping and characteristics as well as lower moisture absorption properties. The prior art lacrosse pockets utilizing traditional runners are typically comprised of leather or an artificial leather material having a texture and feel similar to standard leather with little to no surface alterations.

What is desired, therefore, is an over-molded runner for use in a lacrosse pocket which provides for improved ball handling characteristics while also absorbing less moisture than prior art lacrosse runners. Indeed, a combination of characteristics, including molded surface textures on the over-molded runner have been found to be necessary in improving the control of a lacrosse ball within a strung lacrosse head. Also desired is an over-molded runner which is easy to produce with a variety of different surface characteristics including both textures and colors.

SUMMARY OF THE INVENTION

The present invention provides over-molded runners for use in stringing a lacrosse pocket. Generally, the runners run longitudinally from the scoop section to the throat section and are capable of providing improved handling characteristics over traditional runners typically comprised of leather or a synthetic leather material.

More particularly, the inventive over-molded runners may include a variety of different surface textures so as to both modify the appearance and provide more secure ball control. The various over-molded runners may be comprised of a generally over-molded portion and a substrate with the over-molded portion covering substantially the entire surface of the substrate portion. Furthermore, the over-molded runners may include openings so that other portions of the pocket including shooting strings as well as pocket lace may be fed through and connected to the over-molded runner in forming the strung lacrosse pocket within the lacrosse head.

Advantageously, a complete contact surface of the over-molded runner is created for contacting a lacrosse ball in certain embodiments where the lace and shooting string are fed through openings on the rearward side of the over-molded runner, whereas prior art runners typically utilize shooting strings surrounding the runner so that the runner is not in complete and continuous contact with the ball while in the lacrosse pocket.

The inventive over-molded runner may include texture with a variety of different protrusions or indentations depending upon the embodiment of the runner. Furthermore, the runner may also include a fairly smooth surface without texturing, indentions, or protrusions. Yet furthermore, the over-molded portion may be comprised of a variety of different materials so that the over-molded runner may take on an aesthetic appearance having color.

Generally, a lacrosse pocket may utilize more than one over-molded runner in forming a lacrosse pocket as each over-molded runner typically replaces one of the traditional prior art runners used in forming a lacrosse pocket.

Advantageously, to produce a lacrosse head having improved pocket characteristics, over-molded runners are strung within the lacrosse head from approximately the scoop to about the throat in forming the lacrosse pocket with shooting strings and lace connected to and associated with each over-molded runner utilized within the strung lacrosse head.

An object of the invention, therefore, is an over-molded runner having characteristics which provide for improved ball handling characteristics.

Another object of the invention is an over-molded runner comprising a surface having textures including protrusions, indentations, and grooves for assisting and contact with a held lacrosse ball.

Still another object of the invention is an over-molded runner which is less susceptible to alterations due to the absorption of moisture.

Yet another object of the invention is an over-molded runner having a substrate portion and an over-molded portion.

Another object of the invention is a lacrosse head with at least one over-molded runner integrated therein with the runner from approximately the scoop portion of the lacrosse head to the throat portion of the lacrosse head.

These aspects and others that will become apparent to the artisan upon review of the following description can be accomplished by providing an over-molded runner having substrate portion and an over-molded portion wherein the over-molded runner may be strung into a lacrosse head to provide for improved performance characteristics as well as create a pocket less susceptible to poor performance from the absorption of moisture.

DETAILED DESCRIPTION OF THE PREFERRED EMBODIMENTS

Figure 1:
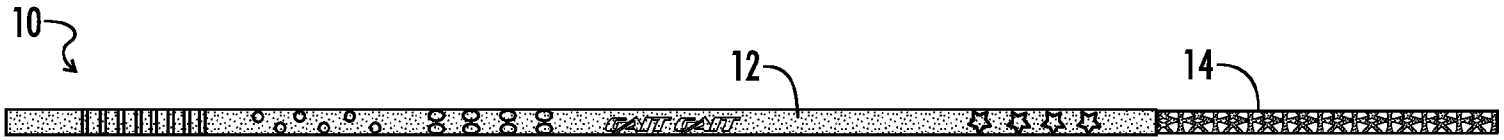
FIG. 1 is an illustration of an embodiment of the over-molded runner of the present invention.

Referring generally now to FIG. 1, an over-molded runner made in accordance with the current disclosure is shown and generally designated by the numeral 10. Over-molded runner 10 is used with a lacrosse head (not shown) and generally is strung from the scoop of a lacrosse head to the throat of a lacrosse head in forming the pocket of a lacrosse stick. Generally, over-molded runner 10 includes over-molded portion 12 and substrate material 14 in comprising over-molded runner 10. Depending on the embodiment, substrate material 14 may or may not be expose as over-molded portion 12 may completely cover substrate material 14.

In a preferred embodiment, over-molded runner 10 is a flexible runner which provides improved runner performance for a pocket of a lacrosse head. Generally, over-molded portion 12 may be comprised of a variety of rubbers, polymers, plastics, thermoplastics, combinations thereof, and other compressible or flexible materials which is used to coat substrate material 14 in comprising over-molded runner 10. Generally, over-molded portion 12 comprises polyurethane or a rubber material which preferably covers at least 50 percent of the surface area of substrate material 14, and most preferably, covers at least 80 percent of the surface area of substrate material 14.

Figure 2:
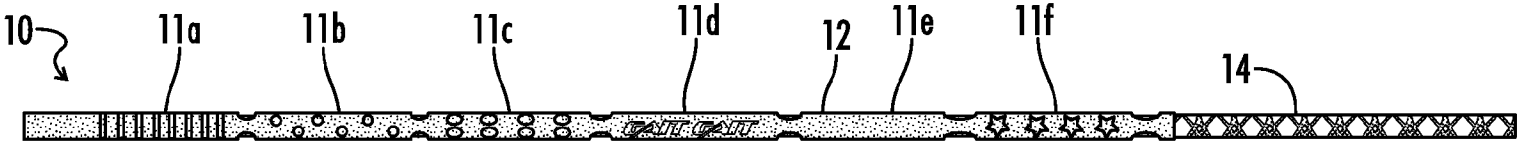
FIG. 2 is an illustration of an embodiment of possible textures for an over-molded runner.

Advantageously, over-molded portion 12 may have a variety of different surface properties molded in to over-molded portion 12 of over-molded runner 10. More specifically, over-molded portion 12 may be completely smooth or have various textures molded into the runner with the different textures illustrated in FIG. 2. Such different textures, 11*a*, 11*b*, 11*c*, 11*d*, 11*e* and 11*f* may provide greater friction so that the lacrosse ball may be better maintained within the pocket of a strung lacrosse head with over-molded runner 10, and furthermore, such different textures may also provide the player with the ability to provide an increased spin on the lacrosse ball when either shooting or throwing a lacrosse ball out of a strung lacrosse stick including over-molded runners 10. These textures are in no way limiting and either of textures 11 may comprise the entire length of an over-molded runner or combinations may be used including other textures not illustrated.

In further embodiments, over-molded runner 10 may include a variety of different over-molded portions 12 corresponding to different over-molded materials molded onto substrate 14. A variety of methods of molding different materials onto substrate material 14 exist and as such, a variety of molding strategies may be utilized for providing the over-molded materials onto substrate material and forming the over-molded runner.

Figure 3A:
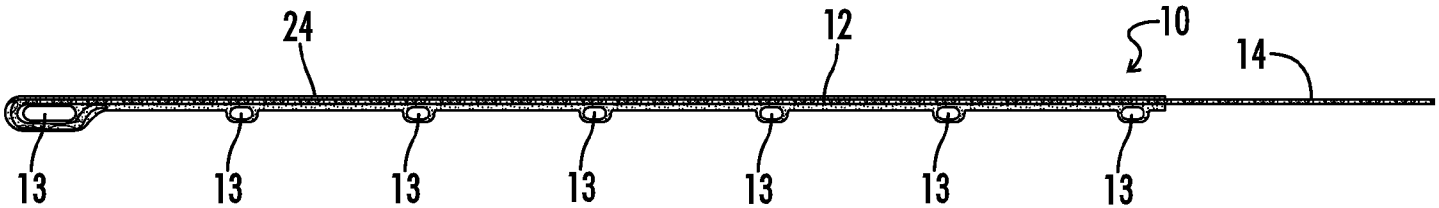
FIG. 3*a* is a side view illustration of an embodiment of an over-molded runner comprising loops.
Figure 3B:
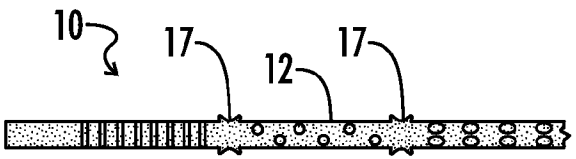
FIG. 3*b* is an illustration of an embodiment of an over-molded runner comprising indents.
Figure 3C:
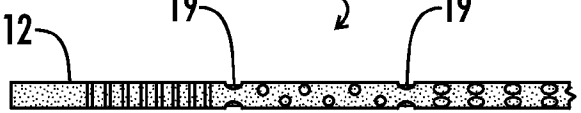
FIG. 3*c* is an illustration of an embodiment of an over-molded runner comprising protrusions.

Referring now to FIG. 3*a*, there is a side view of one embodiment of an over-molded runner of the present invention illustrating loops molded into the runner. Loops 13 provide for the other stringing components of the lacrosse pocket to connect to the overmolded runner 10. By having loops 13 molded into over-molded runner 10, a continuous surface 24 is created which may be in contact with the ball without other stringing components blocking the continuous surface 24. As such, the runners may be in continuous contact with the lacrosse ball while the ball is within the head without the periodic interruption of other strings crossing in front of the runners. Additionally, at each loop point the over-molded runner may also include protrusions 17 as illustrated in FIG. 3*b*. or indents 19 as illustrated in FIG. 3*c* or other formations. Both the protrusions 17 and indents 19 facilitate the incorporation of the stringing of the pocket through loops 13 of the over-molded runners.

Additionally, a variety of different substrate materials may be utilized in creating over-molded runners 10. Some types of substrates include braided materials including both round braided materials and flat braided materials. In further embodiments, other materials may be included in both a round or flat nature, thus not limiting either design to braided materials. Generally, the braided material comprising substrate material 14 preferably comprises braided nylon or braided polyester, but furthermore, can include natural braided material such as cotton, hemp, leather, or the like. Furthermore, a variety of different polymers may be utilized in forming braided material comprising substrate material 14. Other substrates may include leather or synthetic leather. While preferably the over-molded runner comprises at least one relatively flat surface, the substrate material may comprise a variety of shapes and materials.

More specifically, substrate material 14 may also be a non-braided material which can comprise leather, polyester, plastics, flexible polymers, or the like. Essentially, substrate material 14 may comprise any flexible material which may be over-molded and utilized to form over-molded runner 10 which can subsequently be utilized in a lacrosse pocket. Preferably, substrate material 14 is durable enough to withstand the stresses imposed when in use in a lacrosse pocket, and furthermore, maintains a degree of flexibility so that a lacrosse pocket comprising an over-molded runner is not too rigid while also being fairly non-elastic. Additionally, substrate material 14 may comprise a series of non-braided elements which can, in their entirety, be over-molded to form one over-molded runner.

Advantageously, the over-molding portion 12 may provide moisture resistance properties to the runner and as such, provide for a lacrosse head strung with over-molded runner 10 having less susceptibility to runner stretching as often occurs with traditional pockets when used in wet conditions. Additionally, the over-molding of the over-molded runners provides for additional resistance to abrasion of the runners as is caused from scooping or otherwise picking the lacrosse ball up from the turf or surface on which a game is played.

Figure 4:
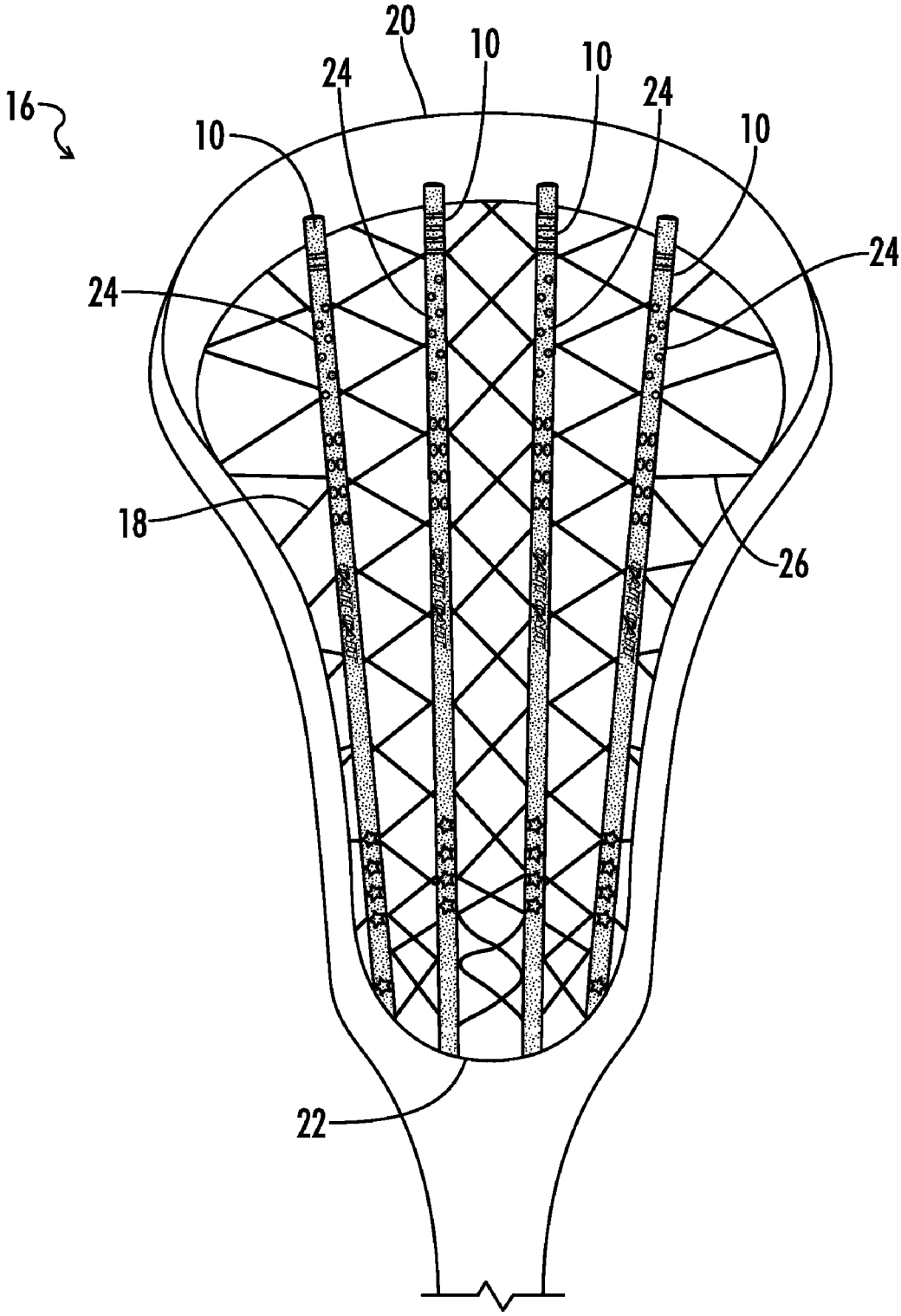
FIG. 4 is an illustration of a lacrosse head strung with multiple over-molded runners.

FIG. 4 illustrates lacrosse head 16 strung with lacrosse pocket 18 including over-molded runners 10 running from scoop 20 to throat 22 of the strung lacrosse head. As one can see in this embodiment of over-molded runners 10, a continuous surface for contact with a lacrosse ball is achieved on continuous surface 24 of the runners as lacing 26, threads in openings (not shown) on the rearward side of over-molded runners 10. Previously as illustrated in FIG. 3*a*, embodiments may have openings 15, for the threading of laces and other strings therethrough, which is also the embodiment of runners 10 as utilized in FIG. 5 as the strings thread through openings 13 in the rear side of runners 10 to provide continuous surface 24 of runners 10. Alternatively, in further embodiments, string 26 used to comprise pocket 18 with runners 10 may also surround over-molded runners 10 in the typical fashion which will still provide the added benefit of greater friction and less susceptibility to moisture in prior art runners.

Yet furthermore, the runners as illustrated in FIG. 4 may include a variety of different surface textures as well as colors so that players may tailor-make their pocket specifically to their particular aesthetic and performance requirements.

Further embodiments of the overmolded runner of the present invention may include a completely molded runner without a substrate material. Generally the inventive runners may be entirely molded and can possess many of the surface characteristics as the previously described runners but advantageously may be entirely molded. Such runners can include loops, attachment points, and various indentations so as to be strung into lacrosse products and form the pocket for a lacrosse stick. In certain embodiments the runners may include openings so as to be utilized similar to a traditional leather runner within a lacrosse pocket. In yet further embodiments the surface appearance and loops may include similar features as found in FIGS. 1, 2, 3*a* and 3*b* though includes only a molded portion. Such completely molded runner is advantageously easier to produce and with the available polymers, is durable for extended performance.

Accordingly, by the practice of the present invention, over-molded runners for a lacrosse pocket of a lacrosse head having heretofore unrecognized characteristics are described. The over-molded runners provide for improved game play characteristics while also being less susceptible to moisture.

The disclosure of all cited patents and publications referred to in this application are incorporated herein by reference.

The above description is intended to enable the person skilled in the art to practice the invention. It is not intended to detail all the possible variations and modifications that will become apparent to the skilled worker upon reading the description. It is intended, however, that all such modifications and variations be included within the scope of the invention that is defined by the following claims. The claims are intended to cover the indicated elements and steps that any arrangement or sequence that is effective to meet the objectives intended for the invention, unless the context specifically indicate the contrary.

What is claimed is:

1. A pocket for a lacrosse head, the lacrosse head including a scoop, a throat, a first side, a second side, a front and a back, the pocket comprising:

a first over-molded runner engaging the scoop and the throat;

a second over-molded runner engaging the scoop and the throat and positioned substantially adjacent to the first runner;

each over-molded runner includes an overmolded portion covering at least about 50% of a substrate material, with each overmolded runner having a first side with surface characteristics and a second side with at least one loop, the over-molded portion affixed to the interior substrate, the over-molded runner having at least one generally flat surface; and lacing of the pocket extending through the at least one of the loops of the over-molded runners.

2. The pocket of claim 1 wherein the first side of each overmolded runner has a substantially continuous surface.

3. The pocket of claim 1 wherein the surface characteristics of the first side of each overmolded runner comprises a relatively smooth surface.

4. The pocket of claim 1 wherein the surface characteristics of the first side of each overmolded runner comprises a textured surface with at least one of protrusions, indentations, and grooves.

5. The pocket of claim 1 further comprising indents at the location of the at least one loop of the second side of the over-molded runner.

6. The pocket of claim 1 further comprising protrusions at the location of the at least one loop.

7. The pocket of claim 1 wherein the over-molded portion comprises a rubber material.

8. The pocket of claim 1 wherein the overmolded portion comprises a polyurethane material.

9. A pocket for a lacrosse head, the lacrosse head including a scoop, a throat, a first side, a second side, a front and a back, the pocket comprising:

a first runner engaging the scoop and the throat;

a second runner engaging the scoop and the throat and positioned substantially adjacent to the first runner;

each over-molded runner includes an overmolded portion covering at least about 70% of a substrate material, with each overmolded runner having a first side with surface texture and a second side with multiple loops; the over-molded portion affixed to the substrate and pocket lace engaging at least some of the loops on the second side of the over-molded runners and engaging the lacrosse head.

* * * * *